US007304441B2

(12) United States Patent
Chen et al.

(10) Patent No.: US 7,304,441 B2
(45) Date of Patent: Dec. 4, 2007

(54) METHOD AND APPARATUS FOR DRIVING DISCHARGE LAMPS IN A FLOATING CONFIGURATION

(75) Inventors: Wei Chen, Campbell, CA (US); Simon Tsai, Taipei County (TW)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 11/198,029

(22) Filed: Aug. 5, 2005

(65) Prior Publication Data

US 2006/0033455 A1 Feb. 16, 2006

Related U.S. Application Data

(60) Provisional application No. 60/599,434, filed on Aug. 5, 2004.

(51) Int. Cl.
*H05B 37/02* (2006.01)

(52) U.S. Cl. ..... 315/300

(58) Field of Classification Search ..... 315/169.1, 315/169.2, 169.3, 209, 224, 246, 307, 299, 315/300, 308, 310, 311
See application file for complete search history.

(56) References Cited

U.S. PATENT DOCUMENTS 5,872,429 A * 2/1999 Xia et al. ..... 315/194
6,087,757 A * 7/2000 Honbo et al. ..... 310/316.01
6,114,814 A 9/2000 Shannon et al.
6,330,176 B1 * 12/2001 Thrap et al. ..... 363/142
6,396,722 B2 5/2002 Lin
6,566,821 B2 * 5/2003 Nakatsuka et al. ... 315/209 PZ
6,969,958 B2 * 11/2005 Henry ..... 315/291
7,187,139 B2 * 3/2007 Jin ..... 315/274
2005/0062436 A1 * 3/2005 Jin ..... 315/244

OTHER PUBLICATIONS

Taiwan Pre-Action Notification. Taiwanese Patent Application No. 094126283. Sep. 30, 2006, English translation and original, 7 pages.

* cited by examiner

*Primary Examiner*—Shih-Chao Chen
*Assistant Examiner*—Minh Dieu A
(74) *Attorney, Agent, or Firm*—Perkins Coie LLP; Zhou Lu

(57) ABSTRACT

A technique is described that facilitates sensing current through a load. A method according to the technique includes mounting a discharge lamp in a floating point configuration, sensing current through the discharge lamp, and controlling current through the discharge lamp to improve power conversion efficiency. A device constructed according to the technique may include two AC voltage sources that are out-of-phase with respect to one another. A current sense circuit may be coupled between the AC voltage sources. When a load is connected to nodes of the AC voltage sources, the current sense circuit may sense current between the nodes that is associated with, or perhaps approximates, current through the load.

12 Claims, 11 Drawing Sheets

METHOD AND APPARATUS FOR DRIVING DISCHARGE LAMPS IN A FLOATING CONFIGURATION

CROSS-REFERENCE TO RELATED APPLICATIONS

This Application claims the benefit of U.S. Provisional Application No. 60/599,434 filed Aug. 5, 2004, which is incorporated by reference.

BACKGROUND

A discharge lamp used to backlight an LCD panel such as a cold cathode fluorescent lamp (CCFL) has terminal voltage characteristics that vary depending upon the immediate history and the frequency of a stimulus (AC signal) applied to the lamp. Until the CCFL is "struck" or ignited, the lamp will not conduct a current with an applied terminal voltage that is less than the strike voltage, e.g., the terminal voltage must be equal to or greater than 1500 Volts. Once an electrical arc is struck inside the CCFL, the terminal voltage may fall to a run voltage that is approximately ⅓ the value of the strike voltage over a relatively wide range of input currents. For example, the run voltage could be 500 Volts over a range of 500 microAmps to 6 milliAmps for a CCFL that has a strike voltage of 1,500 Volts. When the CCFL is driven by an AC signal at a relatively low frequency, the CCFL's electrical arc tends to extinguish and ignite on every cycle, which causes the lamp to exhibit a negative resistance terminal characteristic. However, when the CCFL is driven by another AC signal at a relatively high frequency, the CCFL (once struck) will not extinguish on each cycle and will exhibit a positive resistance terminal characteristic. Since the CCFL efficiency improves at the relatively higher frequencies, the CCFL is usually driven by AC signals having frequencies that range from 50 Kilohertz to 100 Kilohertz.

Since resistive components tend to dissipate power and reduce the overall efficiency of a circuit, a typical harmonic filter for a DC to AC converter employs inductive and capacitive components that are selected to minimize power loss, i.e., each of the selected components should have a high Q value. The Q value identifies the "quality factor" of an inductor or a capacitor by indicating the ratio of energy stored to energy lost in the component for a complete cycle of an AC signal at a rated operational frequency. The Q value of a component will vary with the frequency and amplitude of a signal, so a filter must be designed for minimum (or acceptable) loss at the operating frequency and required power level. Also, some DC to AC converter filters incorporate the inductance of the step-up transformer, either in the magnetizing inductance of the primary or in the leakage inductance of the secondary.

A second-order resonant filter formed with inductive and capacitive components is also referred to as a "tank" circuit because the tank stores energy at a particular frequency. The unloaded Q value of the tank may be determined by measuring the parasitic losses of the tank components, i.e., the total energy stored by the tank for each cycle of the AC signal is divided by the total energy lost in the tank components each cycle. A high efficiency tank circuit will have a high unloaded Q value, i.e., the tank will employ relatively low loss capacitors and inductors.

The loaded Q value of a tank circuit may be measured when power is transferred through the tank from an energy source to a load, i.e., the ratio of the total energy stored by the tank in each cycle of the AC signal divided by the total energy lost in the tank plus the energy transferred to the load in each cycle. The efficacy of the tank circuit as a filter depends on its loaded Q value, i.e., the higher the loaded Q value, the purer the shape of the sine wave output. Also, the efficiency of the tank circuit as a power transmitter depends on the ratio of the unloaded Q to the loaded Q. A high efficiency tank circuit will have an unloaded Q set as high as practical with a loaded Q set as low as possible. Additionally, the loaded Q of the tank circuit may be set even smaller to increase the efficiency of the filter, if the signal inputted to the tank has most of its energy in a fundamental frequency and only a small amount of energy is present in the lower harmonic frequencies.

The largest component in a small DC to AC inverter circuit for a CCFL is the step-up transformer. Typically, this transformer includes a primary and a secondary winding coiled around a plastic bobbin mounted to a ferrite core. This type of transformer has two characteristic inductances associated with each winding, i.e., a magnetizing inductance and a leakage inductance. The value of the magnetizing inductance for each winding is measured when the other winding is configured as an open circuit, i.e., a no load state. Also, the value of the leakage inductance for each winding is measured when the other winding is configured as a short circuit.

The intensity of light emitted by a CCFL may be dimmed by driving the lamp with a lower power level (current). Dimming the light emitted by the CCFL enables the user to accommodate a wide range of ambient light conditions. Because the CCFL impedance will increase as the power level driving the lamp is reduced, i.e., an approximately constant voltage with decreasing current, currents in the stray capacitances between neighboring conductors (e.g., ground shields, wiring) and the lamp tend to become significant. For example, if the control circuitry requires that one terminal of the CCFL is tied to signal ground for measuring current through the lamp, the current in the grounded terminal of the lamp will be significantly less than the current flowing into the other terminal of the lamp. In this case, a thermometer effect on the CCFL will be produced, whereby the grounded end of the lamp has almost no current flowing in it and the arc essentially extinguishes while the other end of the lamp is still arcing and emitting light.

The thermometer effect may be greatly reduced by the technique of driving the CCFL, so that the signal at one end of the lamp is equal to and exactly out of phase with the signal at the other end. This technique is typically termed a balanced drive and it may be approximated by driving the CCFL with a floating secondary winding, i.e., neither end of the secondary winding is tied to ground. Moreover, due to the high driving voltage and fairly significant parasitic capacitance between the lamps and chassis, a "floating drive" scheme that drives the two ends of lamps with out of phase AC voltages of the sample amplitude is often required. A single-ended drive may shunt too much current into the parasitic cap at one end, potentially resulting in poor and non-uniform luminance. This may also cause poor backlight performance and short lamp life.

Similarly, External Electrode Fluorescent Lamps (EEFLs) which require higher lamp voltage are often driven in a floating configuration. In addition, the small series intrinsic capacitance may cause the parasitic capacitance in the lamp assembly to divert more current out of lamps. A single-ended drive typically cannot reliably light the lamp.

The floating drive scheme can also be applied to newer light sources, such as Flat Fluorescent Lamps (FFLs). A challenge of the floating drive scheme is how to accurately sense the lamp current in a low cost and space saving manner. Inaccurate sensing of lamp current will result in a poor control of the lamp current, which degrades the lamp life.

One example of an invention that provides efficient control of power switches (MOSFET transistors) supplying electrical power to a discharge lamp such as a CCFL by integrating the switches and control circuitry into a single integrated circuit package is shown in U.S. Pat. No. 6,114,814, which issued Sep. 5, 2000, to John Robert Shannon, et al., entitled "Apparatus for controlling a discharge lamp in a backlighted display", which is incorporated herein by reference. The control circuitry measures the voltages across and currents through the power switches so that the electrical power supplied by the power switches to the CCFL, may be accurately measured.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools, and methods that are meant to be exemplary and illustrative, not limiting in scope. In various embodiments, one or more of the above-described problems have been reduced or eliminated, while other embodiments are directed to other improvements.

It is advantageous to sense current through a load. However, this may be a relatively difficult task. For example, it has proven difficult to sense current through a load, such as a lamp, when the load is mounted in a floating point configuration. One aspect of this difficulty arises due to the fact that in a floating point configuration the load is driven at both ends.

A technique is described herein that facilitates sensing current through a load. A method according to the technique includes mounting a discharge lamp in a floating point configuration, sensing current through the discharge lamp, and controlling current through the discharge lamp to improve power conversion efficiency. Controlling current through the discharge lamp is one example of the advantages of a method according to the technique. Parasitic capacitance is a problem in circuits. Advantageously, in a non-limiting embodiment, the method may further include correcting sense error from parasitic capacitance.

A device constructed according to the technique may include two AC voltage sources that are out-of-phase with respect to one another. A current sense module may be coupled between the AC voltage sources. When a load is connected to nodes of the AC voltage sources, the current sense module may sense current between the nodes that is associated with, or perhaps approximates, current through the load. The load may or may not be connected in a floating point configuration. The load may include a lamp or a bank of lamps, or some other load. In an embodiment that includes lamps, the lamps may include discharge lamps, uniform discharge lamps, or some other type of lamp. The device may or may not include a switching network that receives a DC voltage input and outputs the two AC voltage sources. The current sense module may or may not include a parasitic capacitance compensation module that is effective to correct sense error from parasitic capacitance.

A system constructed according to the technique may include a switching network; a first resonant tank, coupled to the switching network; a second resonant tank, coupled to the switching network, wherein the first resonant tank and the second resonant tank are out-of-phase; a load coupled in a floating drive configuration between the first resonant tank and the second resonant tank; and a current sense module, coupled between the first resonant tank and the second resonant tank, effective to accurately sense current through the load. The current sense module may be magnetically coupled to the load at a zero potential location, a zero AC potential location, AC ground, or ground. By zero, what is meant is "approximately zero." The system may or may not include a parasitic capacitance compensation module.

The system constructed according to the technique may include a switching network that receives a DC signal and outputs a first square wave signal and a second square wave signal, a first resonant tank that receives the first square wave signal from the switching network, and/or a second resonant tank that receives the second square wave signal from the switching network. The system may include a first resonant tank that outputs a first analog signal, a second resonant tank that outputs a second analog signal, and/or a load that is driven by the first analog signal at a first end and the second analog signal at a second end. The system may include an inverter controller coupled between the first resonant tank and the second resonant tank. The first resonant tank may or may not be a first filter and the second resonant tank may or may not be a second filter.

The proposed circuits can offer, among other advantages, a nearly symmetrical voltage waveform to drive discharge lamps, accurate control of lamp currents to ensure good reliability, or long battery lifetime. These and other advantages of the present invention will become apparent to those skilled in the art upon a reading of the following descriptions and a study of the several figures of the drawings.

BRIEF DESCRIPTION OF THE DRAWINGS

Embodiments of the invention are illustrated in the figures. However, the embodiments and figures are illustrative rather than limiting; they provide examples of the invention.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments, of the invention.

Figure 1:
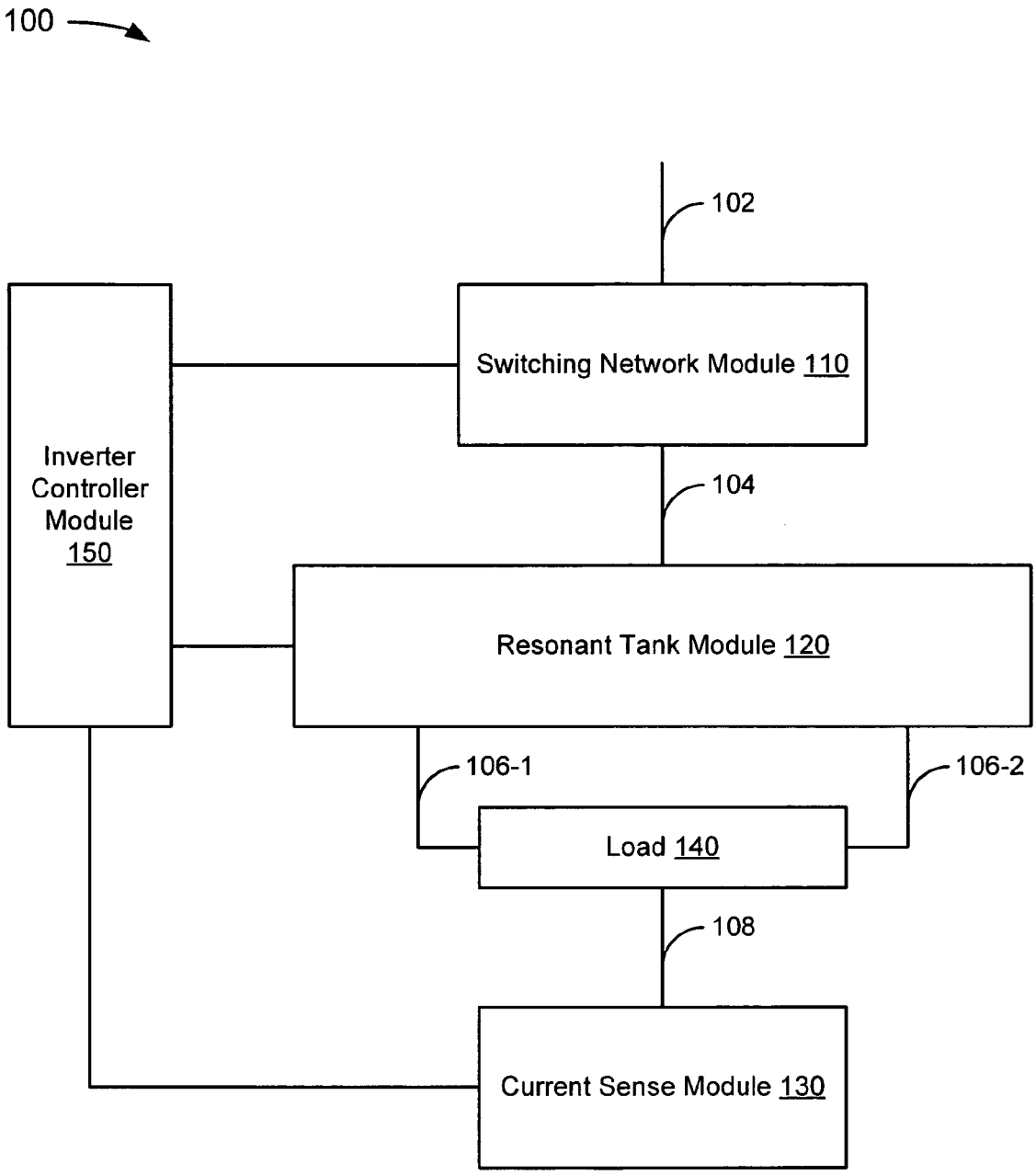
FIG. 1 depicts an example of a circuit with a module for sensing current through a load.

FIG. 1 depicts an example of a circuit 100 with a module for sensing current through a load 140. FIG. 1 is intended to show a conceptual depiction of a system according to a non-limiting embodiment. In the example of FIG. 1, the circuit 100 includes a switching network module 110, a resonant tank module 120, a current sense module 130, and an inverter controller module 150. Switching networks, resonant tanks, and inverter controller modules are well-known in the electronic arts, so these components need not be described in detail to enable one of ordinary skill in the relevant arts to practice the teachings described herein. Examples of various embodiments of the current sense module 130 are depicted in FIGS. 2-12. The inverter controller module 150 may control behavior of, by way of example but not limitation, transistors in the switching network module 110 using, by way of example but not limitation, feedback from the resonant tank module 120 and/or the current sense module 130.

In operation, a voltage is provided to the switching network module 110 on line 102. In a non-limiting embodiment, the voltage is a DC voltage. In a non-limiting embodiment, the switching network module 110 converts the DC voltage into an AC voltage. This may be accomplished using, by way of example but not limitation, multiple transistors to produce a square wave signal on the line 104. In a non-limiting embodiment, the switching network module 110 includes four transistors, and produces two out-of-phase square wave signals on the line 104. In this embodiment, the line 104 may actually include two lines (not shown). As used herein, out-of-phase signals typically refer to signals that have the same frequency, but have cycles that are not synchronized. In a specific example, the signals may be 180 degrees out of phase. The out-of-phase signals may have different periods, wherein the period of one of the signals is a multiple of the period of another of the signals, though in a non-limiting embodiment the out-of-phase signals have the same frequency. The out-of-phase signals may or may not have the same amplitude, though in a non-limiting embodiment the out-of-phase signals have the same amplitude. The use of the term "same" herein is intended to mean sufficiently identical that the differences are negligible. Other signal variations are also possible.

In operation, the output of the switching network module is received at the resonant tank module 120 through the line 104. In a non-limiting embodiment, the resonant tank module 120 converts the signal from the switching network module 110 into, by way of example but not limitation, two analog AC signals, which are output on the lines 106-1 and 106-2 (referred to hereinafter as the lines 106). In an embodiment wherein the resonant tank module 120 receives two square wave signals on the line 104, the resonant tank module 120 may include two resonant tanks (not shown), or filters that convert the square wave signals into two analog AC signals. The analog AC signals may be, in a non-limiting embodiment, out-of-phase with respect to one another.

The voltages associated with the analog AC signals output from the resonant tank module 120 on the lines 106 drive the load 140 at both ends of the load 140. The load is operationally connected to the lines 106 in, by way of example but not limitation, a floating point configuration or a floating drive configuration. The load 140 may be a lamp, such as a CCFL. Measuring voltages in floating lamp configurations is recognized as a challenging proposition.

Advantageously, the proposed current sense module 130 meets this challenge. Using feedback from the current sense module, the circuit 100 converts DC power to AC power in a nearly symmetrical voltage waveform to drive the load 140. Accurate control of the load current tends to increase reliability, and, if a battery is used, increase battery run time. The current sense module 130 is coupled to the load 140 by line 108. In alternative embodiments, the current sense module 130 may be coupled between the resonant tank module 120 and the load 140. Examples of current sense module 130 are described later with reference to FIGS. 2-12.

Figure 2:
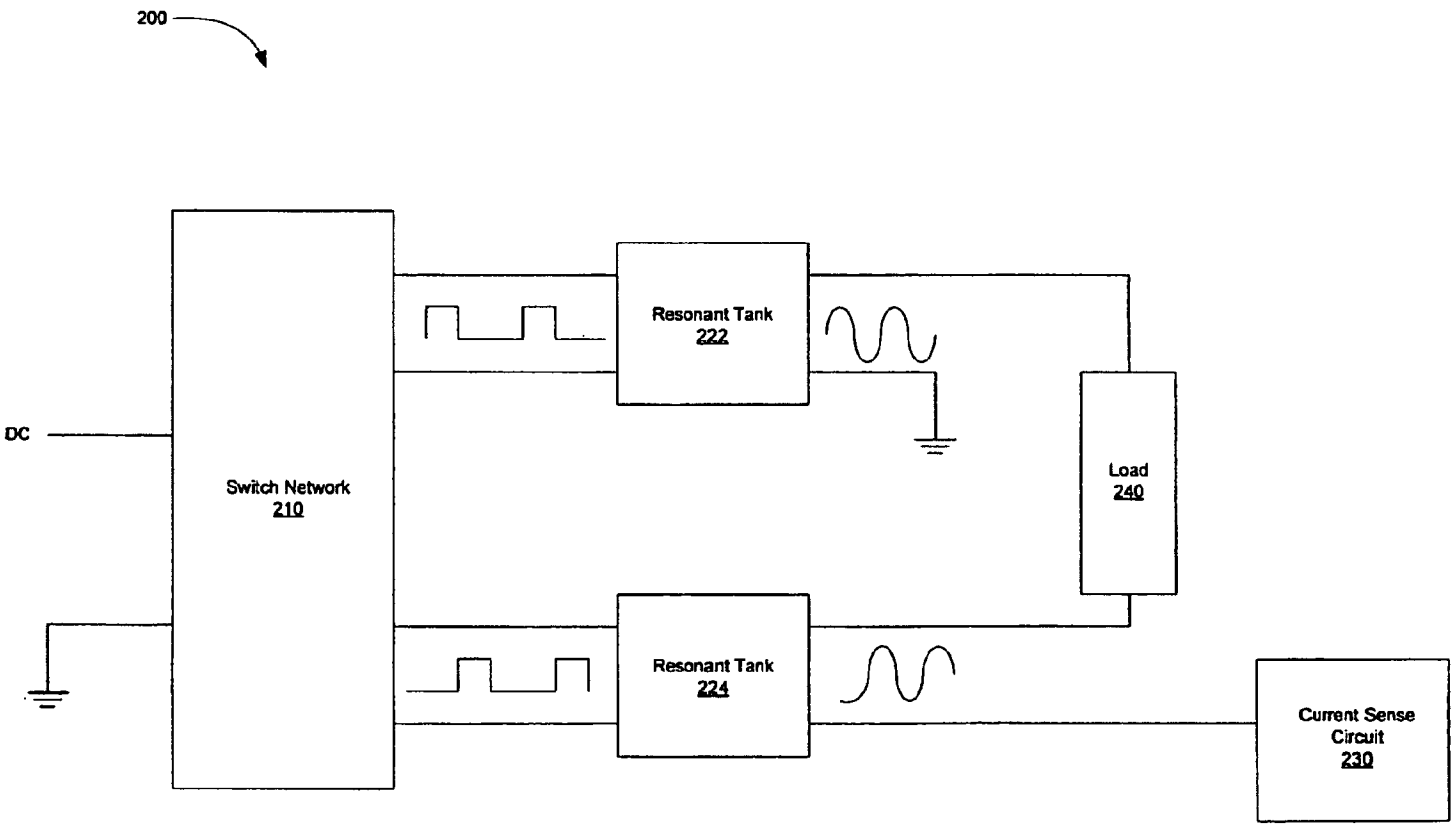
FIG. 2 depicts an example of a circuit with a component for sensing current through a load.

FIG. 2 depicts an example of a circuit 200 with a component for sensing current through a load. In the example of FIG. 2, the circuit 200 includes a switch network 210, a resonant tank 222, a resonant tank 224, a current sense circuit 230, and a load 240. In an embodiment, the resonant tanks 222, 224 may include filters.

In operation, the switch network 210 has a DC signal as input and two AC signals as output. As shown in the example of FIG. 2, the AC signals have square wave forms. The resonant tank 222 has a first of the AC signals from the switch network 210 as input and an AC signal as output. The resonant tank 224 has a second of the AC signals from the switch network 210 as input and an AC signal as output. As shown in the example of FIG. 2, the AC signals output from the resonant tanks 222, 224 have analog wave forms. The load 240 is driven at one end by the AC signal from the resonant tank 222 and from the other end by the AC signal from the resonant tank 224. The current sense circuit 230 senses current between the resonant tank 224 and the load 240. In alternative embodiments, the current sense circuit 230 may be connected at the load 240 (e.g., from the center of the load), between the resonant tanks 222, 224, or at both ends of the load 240.

Certain loads, such as relatively long lamps, are driven at both ends so that, among other reasons, light emitted from the lamps appear uniform. Parasitic capacitance along the length of the lamp, or parasitic capacitance associated with other components of the circuit, make differential driving advantageous in certain applications. A lamp, such as an EEFL, CCFL, or FFL, may be mounted in what is referred to as a floating configuration. However, sensing current through a lamp mounted in this manner is relatively challenging. In the example of FIG. 2, the current sense circuit 230, examples of which are described below, accomplishes the goal of sensing current through the lamp. In non-limiting embodiments, the current sense circuit may be magnetically coupled at a location with no AC voltage swing, at AC ground, at a zero potential location, at a zero AC potential location, at ground potential, or at some other location.

Figure 3:
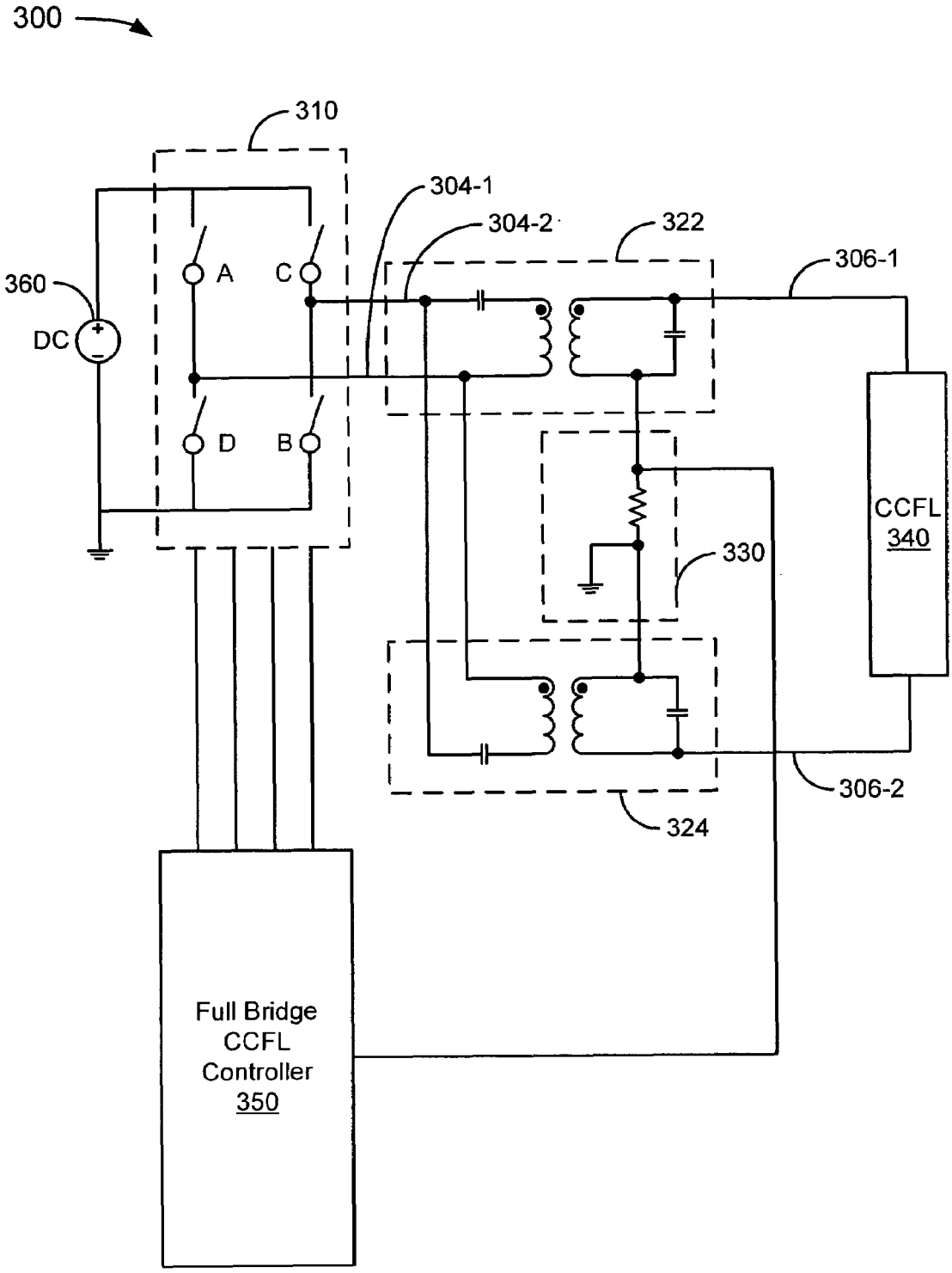
FIG. 3 depicts an example of a circuit including current sense for a differentially driven lamp.

FIG. 3 depicts an example of a circuit 300 including current sense for a differentially driven lamp. The circuit 300 includes a DC voltage source 360, a plurality of switches 310, a filter 322, a filter 324, a current sense component 330, a CCFL 340, and a full bridge CCFL controller 350. The plurality of switches 310 may include, by way of example but not limitation, a plurality of transistors, diodes, or other switching means. The circuit 300 could be modified to include a load other than the CCFL 340, such as, by way of example but not limitation, an EEFL, an FFL, a bank of lamps, or some other load.

The example of FIG. 3 includes a full-bridge topography, but, as one of skill in the relevant art would understand, other topologies including, by way of example but not limitation, push-pull, interleaved single ended inverters, etc. could be used instead. Selection of the desired topology may depend on cost, implementation difficulty, the application for which the circuit is intended, and other factors. The full bridge CCFL controller may include, by way of example but not limitation, an MP 1038 full bridge CCFL controller, which is available from Monolithic Power Systems, Inc. In alternative embodiments, the circuit 300 could be modified to include other CCFL drivers, such as, by way of example but not limitation, the MP 1010B CCFL driver or MP 1026 CCFL driver for handheld applications, both of which are available from Monolithic Power Systems, Inc. The MPS Analog Power Solutions 2005 Short Form Catalog, which includes a description of the MP 1010B, MP 1026, and the MP 1038, is incorporated herein by reference.

In operation, the circuit 300 has a DC signal from the DC voltage source 360 to the plurality of switches 310. When a switch is open, no current flows. When a switch is closed, current flows through the switch. The full bridge CCFL controller 350 provides a plurality of control signals that control the opening and closing of the plurality of switches 310. In the example of FIG. 3, there is one line from the full bridge CCFL controller 350 per switch of the plurality of switches 310, but in other embodiments, the number of switches and lines may be different.

By applying the control signals carefully, a square wave signal is produced. The "high" portion of the square wave signal corresponds to when current flows from the positive terminal ("+") of the DC voltage source 360, and the "low" portion of the square wave signal corresponds to when current flows to the negative terminal ("−") of the DC voltage source 360. For example, if the switches labeled (for illustrative purposes) A and B are closed at the same time, current flows from the positive terminal ("+") of the DC voltage source 360 to the line 304-1 and from the line 304-2 to the negative terminal ("−") of the DC voltage source 360. Thus, the signal on the line 304-1 is "high" while the signal on the line 304-2 is "low". The lines 304-1, 304-2 are referred to hereinafter collectively as the lines 304. If, in this example, the switches A, B are opened and the switches C, D are closed, the corresponding signals on the lines 304 are respectively changed to "low" and "high". By repetitively opening and closing the switches, a square wave signal can be generated on the lines 304. It should be noted that if the switches are opened and closed appropriately, the square wave signals on the lines 304 may be out of phase.

In operation, in the example of FIG. 3, the lines 304 provide the square wave signal to the filters 322, 324. The filters include transistors with primary windings (on the left) and secondary windings (on the right). The capacitors shown in the filter 322, 324 on the primary winding side may, alternatively, be included in the plurality of switches 310. The capacitors shown in the filter 322, 324 on the secondary winding side may, alternatively, be included in the current sense component 330. Note that transformer in the filter 322 is driven out of phase with respect to transformer in the filter 324 (observe the dot convention). The filter 322 converts the square wave signal on line 304-1 to an analog signal on line 306-1, which drives the CCFL 340 at a first end. The filter 324 converts the square wave signal on line 304-2 to an analog signal on line 306-2, which drives the CCFL 340 at a second end. If the square wave signals are out of phase, the analog signals may also be out of phase, thereby differentially driving the CCFL 340 at both ends.

In operation, the analog signals also pass through the current sense component 330, which is coupled to the lines 306-1 through a capacitor (as shown in the example of FIG. 3, the capacitor is in the filter 322, 324, but could be considered part of the current sense component 330). A sense resistance, which may include a current sense circuit, is located within the current sense component 330. In an alternative, the current sense component 330 could include two current sense circuits located, by way of example but not limitation, respectively between the filters 322, 324 and ground. A current sense circuit provides a signal that may be input at the full bridge CCFL controller 350 as feedback associated with CCFL 340 voltage. Given accurate current sense feedback, the full bridge CCFL controller 350 can control the current through the CCFL 340. Controlling current through the CCFL 340 can lead to longer lifetimes for the CCFL 340, greater efficiency, and/or, relatively uniform light emission from the CCFL. Control of the plurality of switches 310 may include changing the duration of control signals from the full bridge CCFL controller 350 to each of the switches.

Figure 4A:
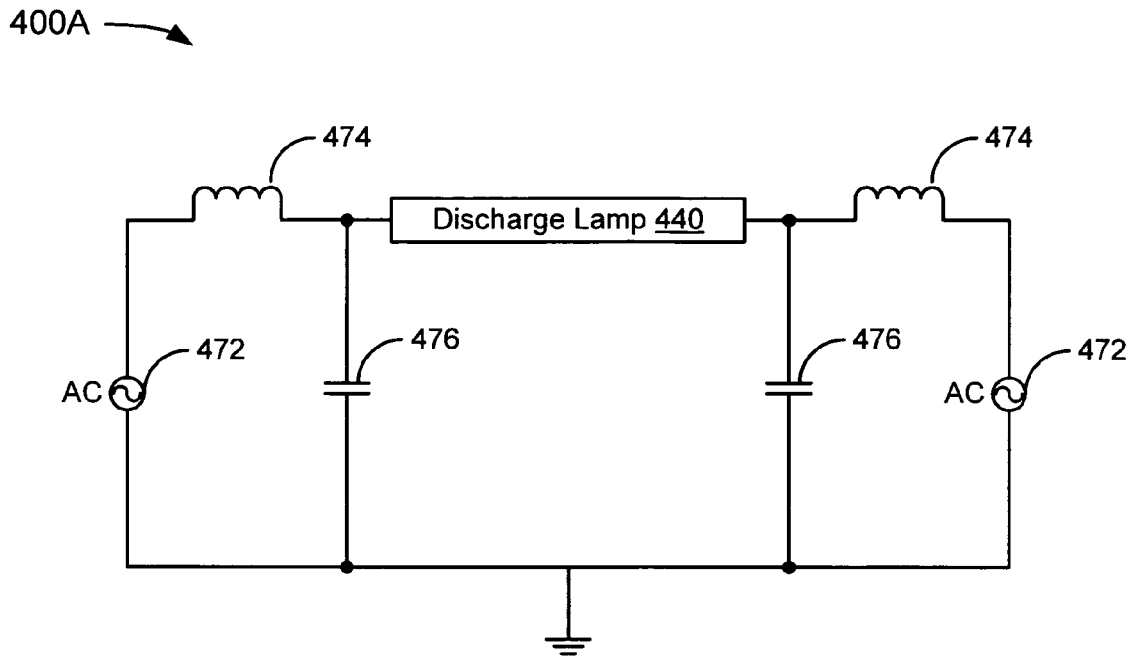
FIGS. 4A and 4B depict an example of an alternative floating drive circuit.
Figure 4B:
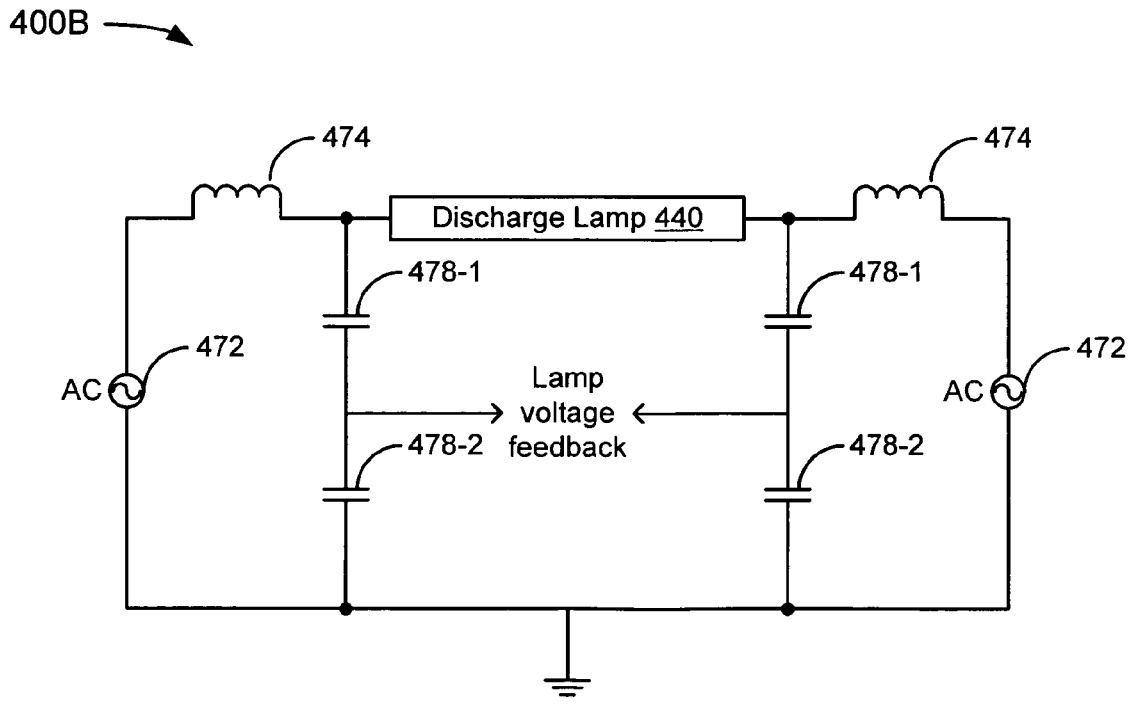

FIGS. 4A and 4B depict an example of an alternative floating drive circuit. In the example of FIG. 4A, a circuit 400A includes a discharge lamp 440, AC voltage sources 472, resonant inductors 474, and resonant capacitors 476. In an embodiment, the AC voltage sources 472 may be derived from the same inverter with equivalent amplitude and opposite phases. The resonant capacitors 476 resonate with the resonant inductors 474 to provide sufficiently high voltage to ignite the discharge lamp 440. In an embodiment, the resonant inductors 474 are leakage inductances integrated into transformers that produce the out-of-phase AC driving voltages of the AC voltage sources 472. In an embodiment, the inductances of the resonant inductors are approximately equal, the amplitude of the AC driving voltages are approximately equal, and the capacitances of the resonant capacitors 476 are approximately equal. The resonant capacitors 476 could be implemented using two capacitors in series as shown in the example of FIG. 4B, in which a circuit 400B includes many of the same elements as shown in FIG. 4A, but includes a pair of capacitors 478-1 and 478-2 and a lamp voltage feedback at the capacitor divider.

Figure 5:
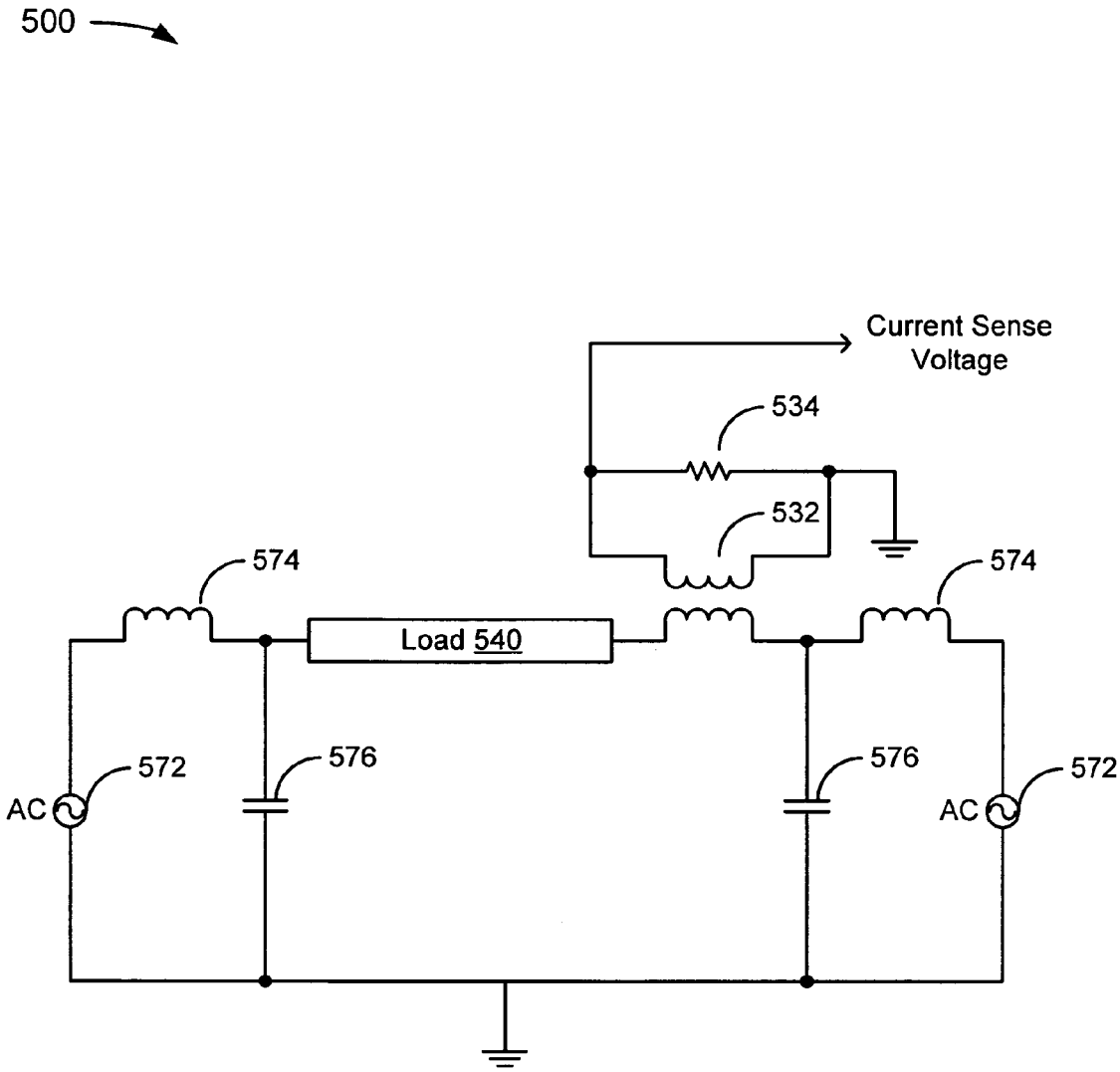
FIG. 5 depicts an example of a circuit with a current sense component that includes a current sense transformer.

FIG. 5 depicts an example of a circuit 500 with a current sense component that includes a current sense transformer. The circuit includes a current sense transformer 532, a sense resistor 534, a load 540, AC voltage sources 572, inductors 574, and capacitors 576. The current sense transformer 532 and sense resistor 534 can be used to sense current through the load 540, particularly when, by way of example but not limitation, sensing lamp current in a floating drive inverter, or when sensing lamp current in a floating drive configuration.

Figure 6:
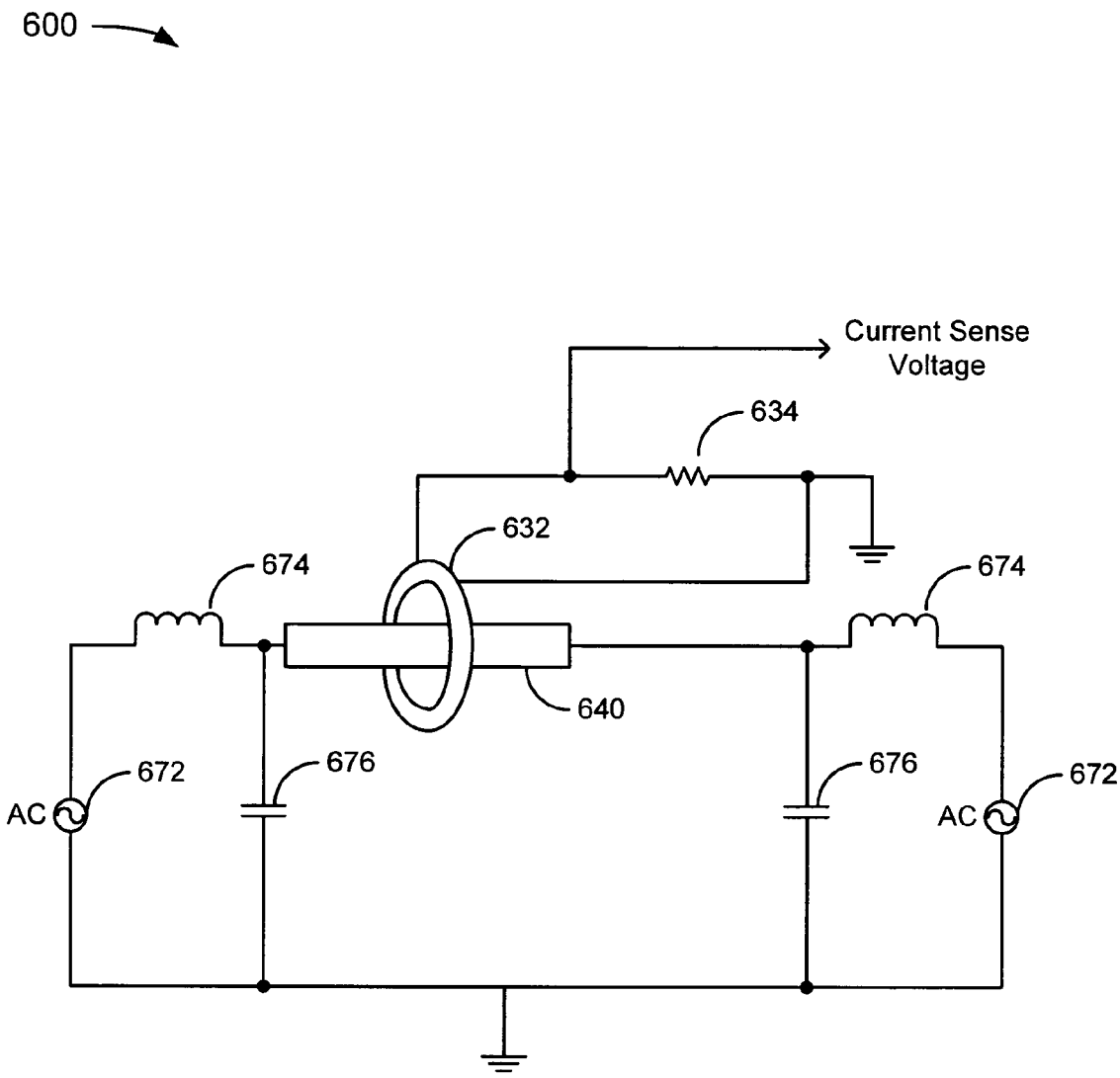
FIG. 6 depicts an alternative circuit with a current sense transformer.

FIG. 6 depicts an alternative circuit 600 with a current sense transformer. The circuit 600 includes a current sense transformer 632, a sense resistor 634, a load 640, AC voltage sources 672, inductors 674, and capacitors 676. In the example of FIG. 6, the current sense transformer 632 is mounted on the center of the load 640. In a non-limiting embodiment, the current sense transformer 632 may be mounted at some other location with zero potential. Alternatively, the current sense transformer 632 may be mounted at some other location where the potential is sufficiently predictable to allow a meaningful current sense.

Figure 7A:
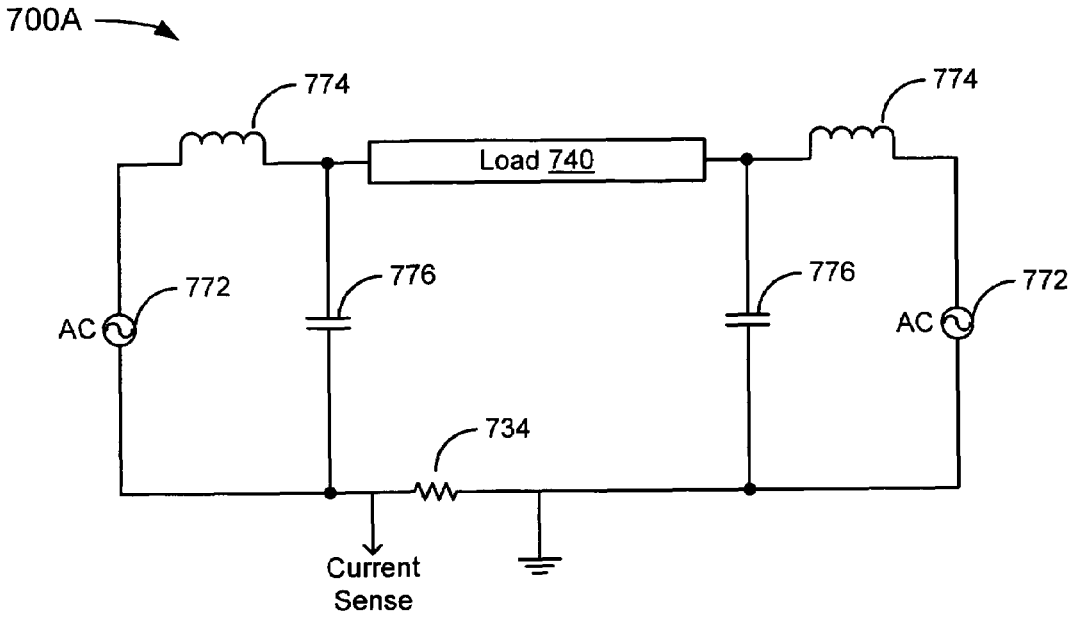
FIGS. 7A and 7B depict examples of circuits with full-wave AC sense.
Figure 7B:
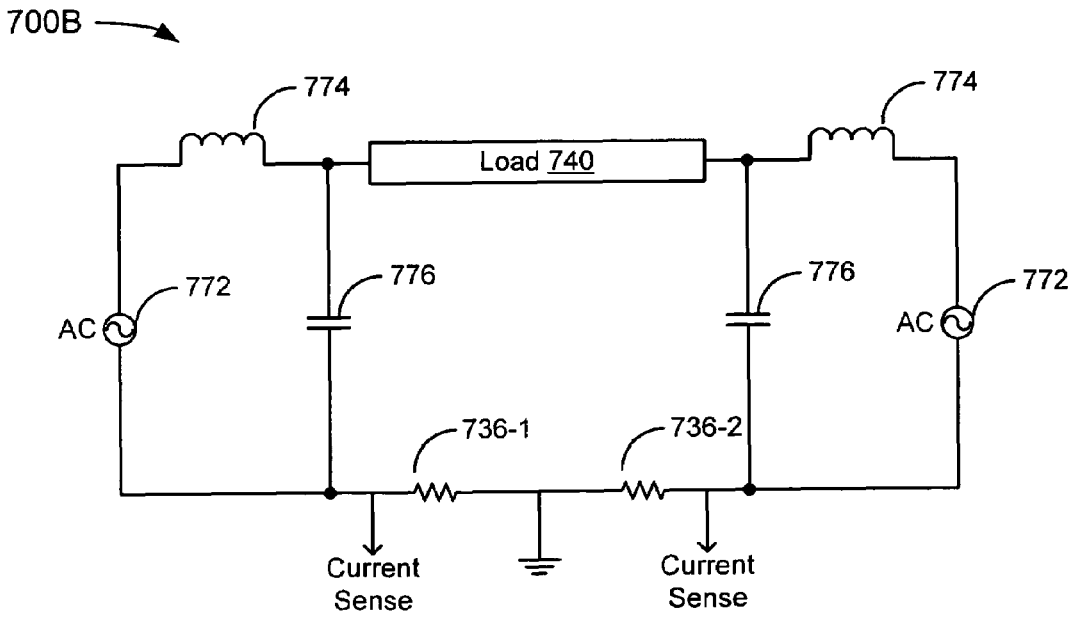

FIGS. 7A and 7B depict examples of circuits with full-wave AC sense. As shown in the example of FIG. 7A, a circuit 700A includes a sense resistance 734, a load 740, AC voltage sources 772, inductors 774, and capacitors 776. By rearranging the return for the capacitors 776, current through the load 740 can be duplicated across the sense resistance 734. In the example of FIG. 7B, the components in circuit 700B are similar to those of circuit 700A, but the circuit 700B includes sense resistances 736-1 and 736-2 (referred to hereinafter collectively as sense resistances 736) instead of a single sense resistance 736. In both the circuit 700A and the circuit 700B the resistance of the sense resistances 734, 736 may be, individually, equal to a sense resistance associated with the load 740. In other words, sense resistance 734=sense resistance associated with the load 740 and sense resistance 736-1=sense resistance 736-1=sense resistance associated with the load 740. The two sense resistances 736 may be used to, by way of example but not limitation, balance impedance on both ends of the load drive.

Figure 8:
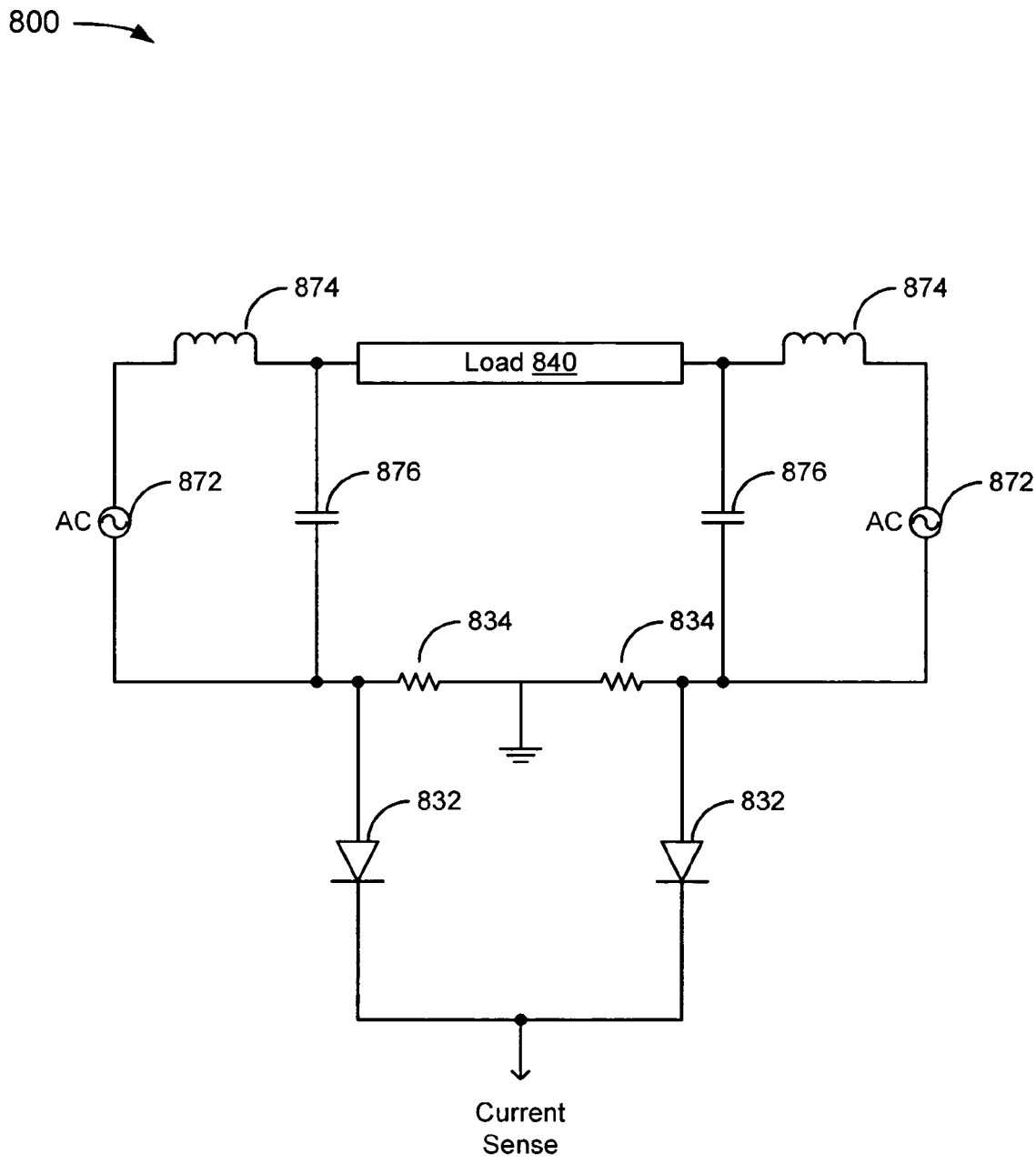
FIG. 8 depicts a circuit with full wave rectifier sense.

FIG. 8 depicts a circuit 800 with full wave rectifier sense. The circuit 800 includes diodes 832, sense resistors 834, a load 840, AC voltage sources 872, inductors 874, and capacitors 876. In the example of FIG. 8, a controller (not shown) may be capable of sensing positive half-wave voltage. Some full bridge inverter drivers, such as the MP1038, made by Monolithic Power Systems, can receive full wave AC current sense feedback. However, other controllers (not shown) may be unable to receive such feedback. The circuit 800 provides feedback that allows the circuit 800 to function with, by way of example but not limitation, controllers that cannot accept full-wave AC input.

Figure 9:
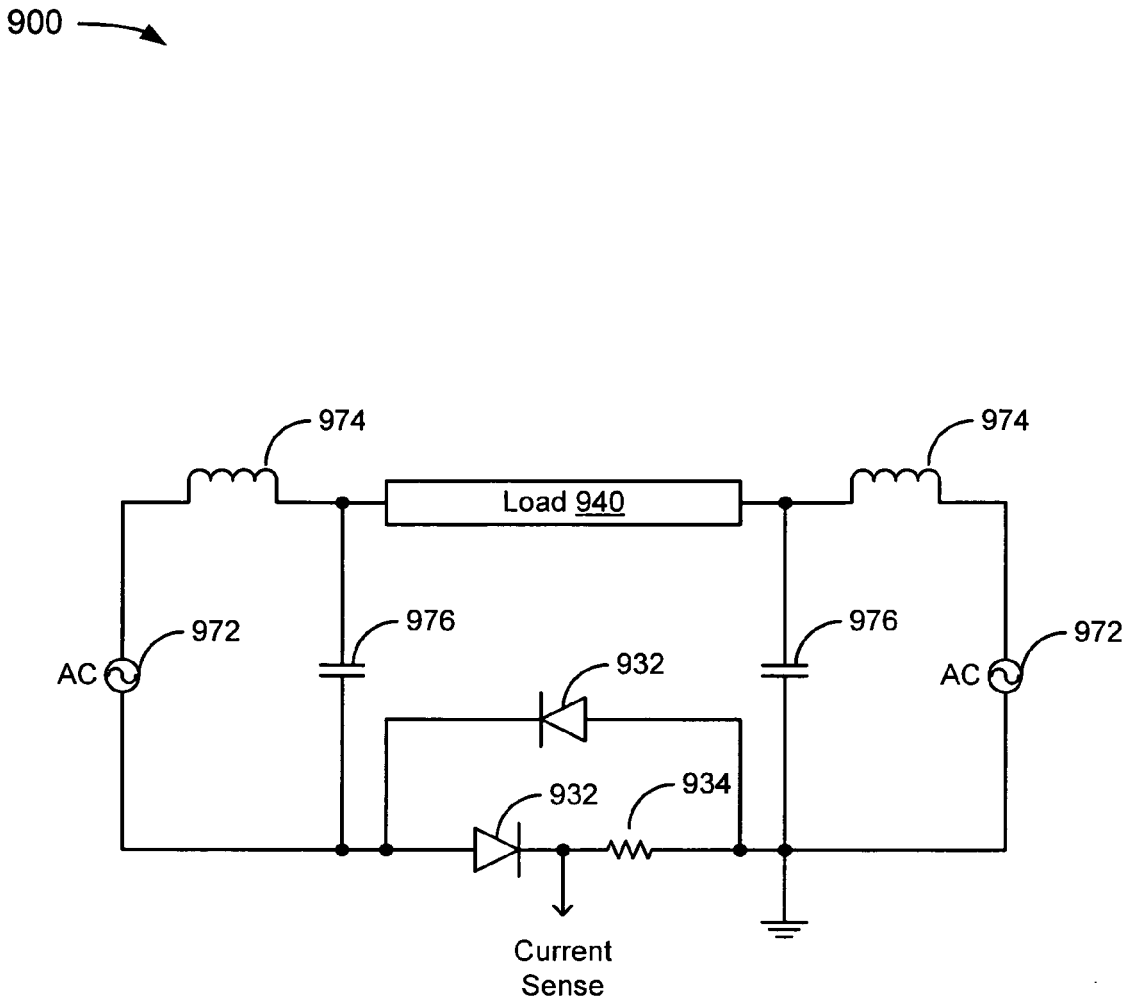
FIG. 9 depicts a circuit with half-wave rectifier sense.

FIG. 9 depicts a circuit 900 with half-wave rectifier sense. The circuit 900 includes diodes 932, sense resistor 934, a load 940, AC voltage sources 972, inductors 974, and capacitors 976. The circuit 900 is similar to the circuit 800 of FIG. 8, but the diodes 932 have a different configuration.

Figure 10A:
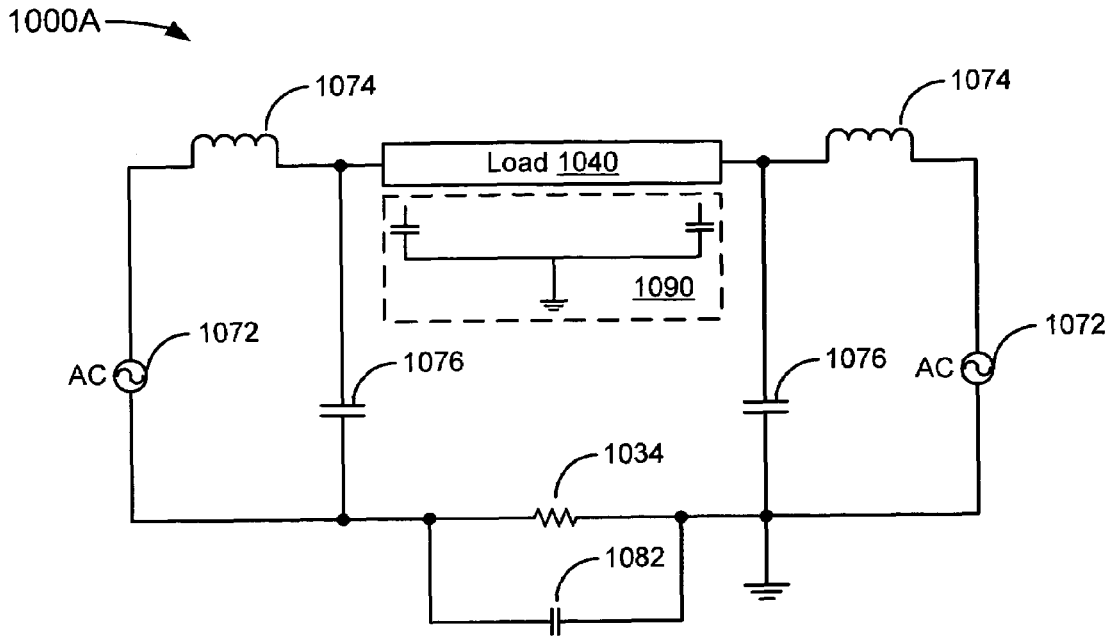
FIGS. 10A and 10B depict examples of circuits with a parasitic capacitance compensation component.
Figure 10B:
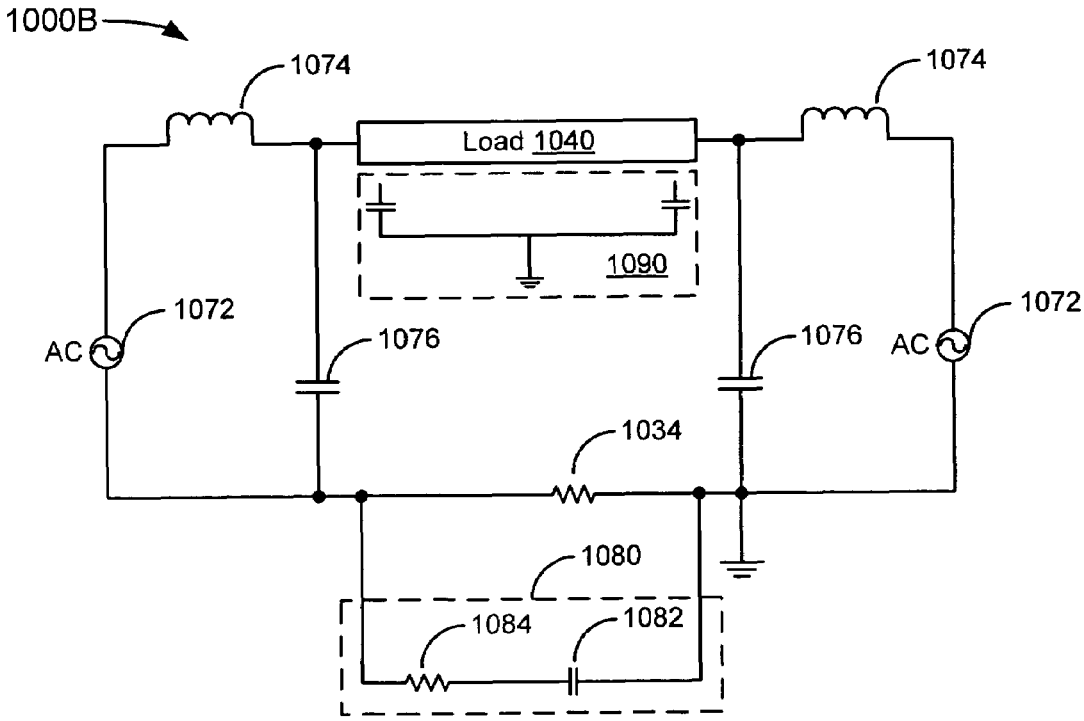

FIGS. 10A and 10B depict examples of circuits 1000A and 1000B with a parasitic capacitance compensation component. The circuit 1000A includes sense resistance 1034, a load 1040, AC voltage sources 1072, inductors 1074, capacitors 1076, and a parasitic capacitance compensation capacitor 1082. Parasitic capacitance associated with the load 1040 is depicted in dashed box 1090. Particularly in large panel display applications, the parasitic capacitance 1090 between a load, such as a lamp, and the chassis (not shown) is not negligible. This may increase the current amplitude sensed across the sense resistor 1034. The parasitic capacitance compensation capacitor 1082 placed, by way of example but not limitation, in parallel with the sense resistor 1034 can be configured to compensate for the parasitic capacitance and facilitate accurate reproduction of current through the load 1040 by the circuit 1000A. In such an embodiment, additional current due to the parasitic capacitor can be shunted into the paralleled parasitic capacitance compensation capacitor 1082.

The circuit 1000B includes sense resistance 1034, a load 1040, AC voltage sources 1072, inductors 1074, capacitors 1076, and a parasitic capacitance compensation network 1080. The parasitic capacitance compensation network 1080 includes a parasitic capacitance compensation capacitor 1082 and a resistor 1084. The parasitic capacitance compensation capacitor 1082, or the parasitic capacitance compensation network 1080 may be referred to as parasitic capacitance compensation components. Other examples of parasitic capacitance compensation components, including a more complicated resistor-capacitor network, serving similar functions to the components described in the FIGS. 10A and 10B should be apparent to those of skill in the relevant art given the teachings provided herein.

Figure 11:
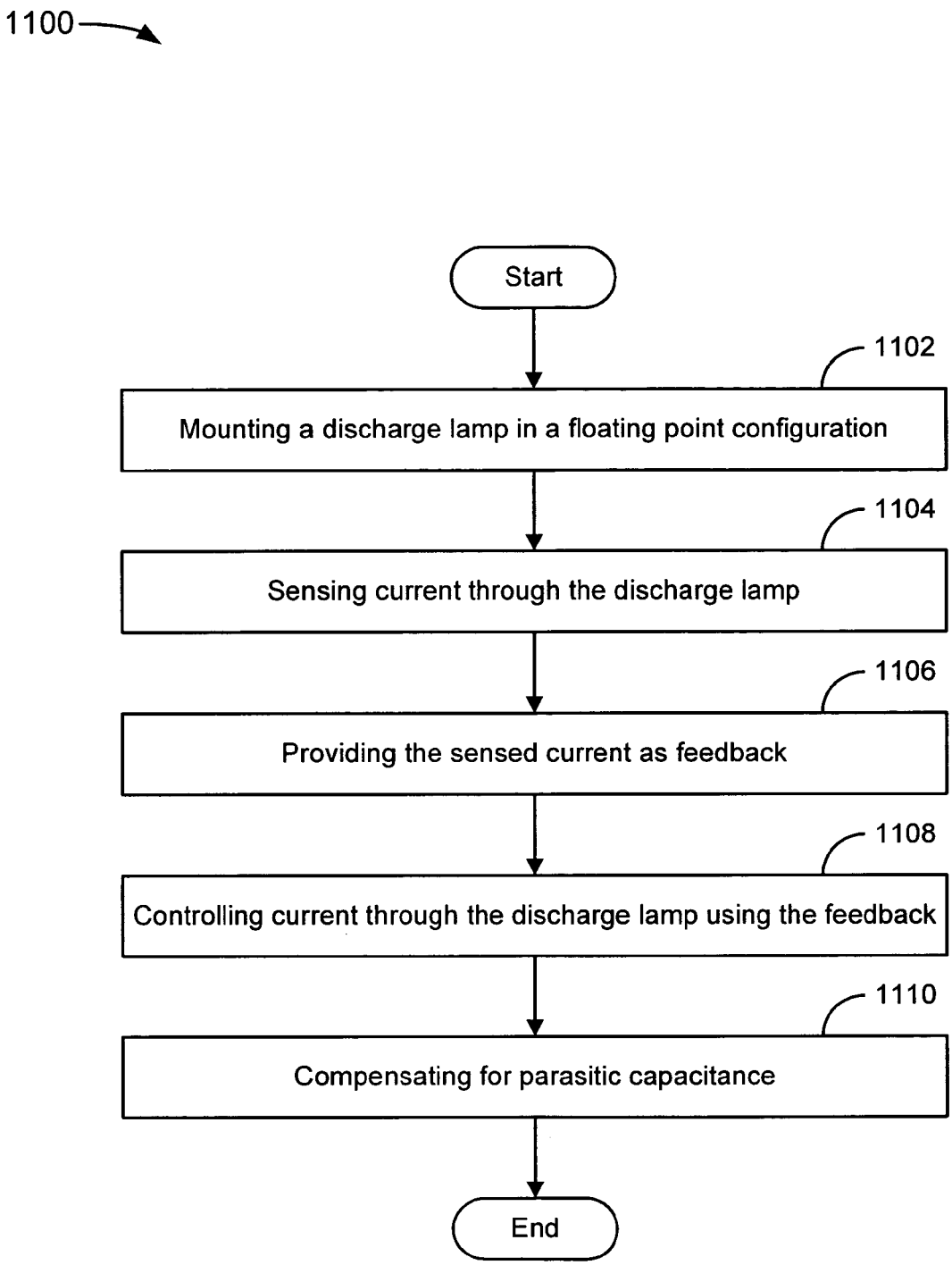
FIG. 11 depicts a flowchart of an example of a method for controlling current through a discharge lamp in a floating point configuration.

FIG. 11 depicts a flowchart 1100 of an example of a method for controlling current through a discharge lamp in a floating point configuration. The flowchart 1100 starts at block 1102 with mounting a discharge lamp in a floating point configuration. The flowchart 1100 continues at block 1104 with sensing current through the discharge lamp, at block 1106 with providing the sensed current as feedback, and at block 1108 with controlling current through the discharge lamp using the feedback. This may be accomplished using a circuit constructed using the teachings provided herein. In the example of FIG. 11, the flowchart 1100 ends at block 1110 with compensating for parasitic capacitance. This last step would be valuable in a circuit for which parasitic capacitance is not negligible.

As used herein, the term "embodiment" means an embodiment that serves to illustrate by way of example but not limitation.

As used herein, "sensing current through a load" refers to either sensing the actual current flowing through the load, sensing mirror current, or sensing current that approximates the current through the load sufficiently accurately to allow control of the current through the load.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A system comprising:

a switching network module when operationally configured, receives a DC signal and outputs a first square wave signal and a second square wave signal;

a resonant tank module, coupled to the switching network module, said resonant tank module when operationally configured, receiving the first square wave signal from the switching network module and the second square wave signal from the switching network module, wherein the first square wave signal is out-of-phase with respect to the second square wave signal, said resonant tank module effective to convert a signal from the switching network module into a first analog signal and a second analog signal, wherein the first analog signal and the second analog signal are out-of-phase; and a current sense module, coupled to the resonant tank module at a third node, effective to accurately sense current through a load, wherein the load is operationally connected to the resonant tank module in a floating drive configuration and the load is driven by the first analog signal at a first end and by the second analog signal at a second end, wherein the third node is different from and not connected directly to the first end and the second end.

2. The system of claim 1, wherein the load is a discharge lamp.

3. The system of claim 1, wherein the load is a uniform discharge lamp.

4. The system of claim 1, wherein the current sense module is magnetically coupled to the load at a zero potential location.

5. The system of claim 1, wherein the current sense module is magnetically coupled to the load at a zero AC potential location.

6. The system of claim 1, wherein the current sense module is magnetically coupled to the load at AC ground.

7. The system of claim 1, further comprising a parasitic capacitance compensation module.

8. The system of claim 1, wherein:

said resonant tank module, when operationally configured, outputs a first analog signal and a second analog signal;

said load is driven by the first analog signal at a first end and the second analog signal at a second end.

9. The system of claim 1, further comprising an inverter controller coupled to the resonant tank module.

10. The system of claim 1, wherein the resonant tank module includes a first filter associated with the first signal and a second filter associated with the second signal.

11. The system of claim 1 wherein the current sense module comprises a full wave rectifier sense circuit.

12. The system of claim 1 wherein the current sense module comprises a half wave rectifier sense circuit.

* * * * *